US006923641B1

(12) United States Patent
Tabor

(10) Patent No.: US 6,923,641 B1
(45) Date of Patent: Aug. 2, 2005

(54) ARTICLE OF MANUFACTURE AND METHOD FOR TREE SHAPED CANDLE HOLDER

(76) Inventor: Aaron Tabor, 650 93rd Ave. N., Naples, FL (US) 34108

( * ) Notice: Subject to any disclaimer, the term of this patent is extended or adjusted under 35 U.S.C. 154(b) by 26 days.

(21) Appl. No.: 10/750,794

(22) Filed: Jan. 2, 2004

(51) Int. Cl.[7] ..... F21V 35/00

(52) U.S. Cl. ..... 431/125; 431/126; 431/291; 431/295; 428/19; D26/19

(58) Field of Search ..... 431/125, 126, 431/291, 295; 428/17–19; 40/124.5; 52/103; 248/175; D11/63, 64, 118; D26/10, 16, 19; D99/19, 21

(56) References Cited

U.S. PATENT DOCUMENTS

| | | | | | |
|---|---|---|---|---|---|
| 255,902 | A | * | 4/1882 | Wengenroth | 428/18 |
| 747,780 | A | | 12/1903 | Schimpf | |
| 887,099 | A | * | 5/1908 | Knittel | 431/295 |
| 1,514,788 | A | * | 11/1924 | Protz | 428/18 |
| 1,629,531 | A | | 5/1927 | Reisert | |
| 1,829,687 | A | * | 10/1931 | Takiguchi | 428/18 |
| 2,216,440 | A | * | 10/1940 | Houle | 428/18 |
| 2,503,587 | A | * | 4/1950 | Murphy | 431/126 |
| 3,144,375 | A | * | 8/1964 | Day | 428/18 |
| 3,617,732 | A | | 11/1971 | Fisher | |
| 3,806,723 | A | * | 4/1974 | Ollom | 431/126 |
| 4,076,490 | A | * | 2/1978 | Hilker | 428/18 |
| 5,221,565 | A | * | 6/1993 | Johnson | 428/18 |
| 5,517,791 | A | * | 5/1996 | Weiss | 52/103 |
| 5,962,088 | A | * | 10/1999 | Tanaka et al. | 428/18 |

FOREIGN PATENT DOCUMENTS

| | | | |
|---|---|---|---|
| DE | 20114877 U1 | * | 2/2003 |
| FR | 2770804 A1 | * | 5/1999 |

* cited by examiner

*Primary Examiner*—Sara Clarke

(57) ABSTRACT

A tree shaped candle holder having at least one twisted tree wire that has a root end and a branch end. At least one bead is wrappingly connected to the tree wire adjacent to the branch end. At least one votive cup is wrappingly connected to the tree wire. A base is connected to the tree wire root end.

2 Claims, 3 Drawing Sheets

ARTICLE OF MANUFACTURE AND METHOD FOR TREE SHAPED CANDLE HOLDER

BACKGROUND OF THE INVENTION

1. Field of the Invention

The present embodiment of the invention relates to an article of manufacture and method for tree shaped candle holder for use in connection with candle bearing ornaments. The article of manufacture and method for tree shaped candle holder has particular utility in connection with tree shaped candle holders comprised of twisted wire.

2. Description of the Prior Art

Article of manufacture and method for tree shaped candle holders are desirable for adding illumination and ornamental beauty to an environment.

The use of candle bearing ornaments is known in the prior art. For example, U.S. Pat. No. 747,780 to Schimpf discloses a candelabrum having a body or upright and arms adjustably and removably connected with the body or upright. A locking member for the upper portion of the arms connects to the body or upright. A candleholder engages with the locking member to hold the member in position. However, the Schimpf '780 patent does not have a tree shaped candle holder comprised of twisted wire, nor does it have roots embedded in a concrete base.

Similarly, U.S. Pat. No. 1,629,531 to Reisert discloses a miniature candelabrum having L-shaped wires having vertical stems twisted together and adapted to form a support to be inserted in a cake. Each wire having an offset portion terminating in a candle receiving socket integral at its upper end. However, the Reisert '531 patent does not have a tree shaped candle holder comprised of twisted wire, nor does it have roots embedded in a concrete base.

Lastly, U.S. Pat. No. 3,617,732 to Fisher discloses an artificial tree having a support base. A trunk member is removably connected to the base with connection means for supporting the trunk outwardly away from the base's support surface. A limb member is connected to the trunk member, an electric light is secured to the limb member and is electrically connected to the power supply means regulated with voltage reduction means connected to the tree's base. The electric light can be directly connected to the trunk member and the tree's base can include means for rotating the trunk member. However, the Fisher '732 patent does not have a tree shaped candle holder comprised of twisted wire, nor does it have roots embedded in a concrete base.

While the above-described devices fulfill their respective, particular objectives and requirements, the aforementioned patents do not describe an article of manufacture and method for tree shaped candle holder that allows tree shaped candle holders comprised of twisted wire. The Schimpf '780, Reisert '531 and Fisher '732 patents make no provision for a tree shaped candle holder comprised of twisted wire, nor does it have roots embedded in a concrete base.

Therefore, a need exists for a new and improved article of manufacture and method for tree shaped candle holder which can be used for tree shaped candle holders comprised of twisted wire. In this regard, the present embodiment of the invention substantially fulfills this need. In this respect, the article of manufacture and method for tree shaped candle holder according to the present embodiment of the invention substantially departs from the conventional concepts and designs of the prior art, and in doing so provides an apparatus primarily developed for the purpose of tree shaped candle holders comprised of twisted wire.

SUMMARY OF THE INVENTION

In view of the foregoing disadvantages inherent in the known types of candle bearing ornaments now present in the prior art, the present embodiment of the invention provides an improved article of manufacture and method for tree shaped candle holder, and overcomes the above-mentioned disadvantages and drawbacks of the prior art. As such, the general purpose of the present embodiment of the invention, which will be described subsequently in greater detail, is to provide a new and improved article of manufacture and method for tree shaped candle holder and method which has all the advantages of the prior art mentioned heretofore and many novel features that result in an article of manufacture and method for tree shaped candle holder which is not anticipated, rendered obvious, suggested, or even implied by the prior art, either alone or in any combination thereof.

To attain this, the present embodiment of the invention essentially comprises at least one twisted tree wire that has a root end and a branch end. At least one bead is wrappingly connected to the tree wire adjacent to the branch end. At least one votive cup is wrappingly connected to the tree wire. A base is connected to the tree wire root end.

There has thus been outlined, rather broadly, the more important features of the embodiment of the invention in order that the detailed description thereof that follows may be better understood and in order that the present contribution to the art may be better appreciated.

The present embodiment of the invention may also include a base votive cup cavity.

There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved article of manufacture and method for tree shaped candle holder that has all of the advantages of the prior art candle bearing ornaments and none of the disadvantages.

It is another object of the present embodiment of the invention to provide a new and improved article of manufacture and method for tree shaped candle holder that may be easily and efficiently manufactured and marketed.

An even further object of the present embodiment of the invention is to provide a new and improved article of manufacture and method for tree shaped candle holder that has a low cost of manufacture with regard to both materials and labor, and which accordingly is then susceptible of low prices of sale to the consuming public, thereby making such article of manufacture and method for tree shaped candle holder economically available to the buying public.

Still another object of the present embodiment of the invention is to provide a new article of manufacture and method for tree shaped candle holder that provides in the apparatuses and methods of the prior art some of the advantages thereof, while simultaneously overcoming some of the disadvantages normally associated therewith.

Even still another object of the present embodiment of the invention is to provide an article of manufacture and method for tree shaped candle holder for tree shaped candle holders comprised of twisted wire.

Lastly, it is an object of the present embodiment of the invention is to provide an article of manufacture and method for tree shaped candle holder for tree shaped candle holders having roots held in a concrete base.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
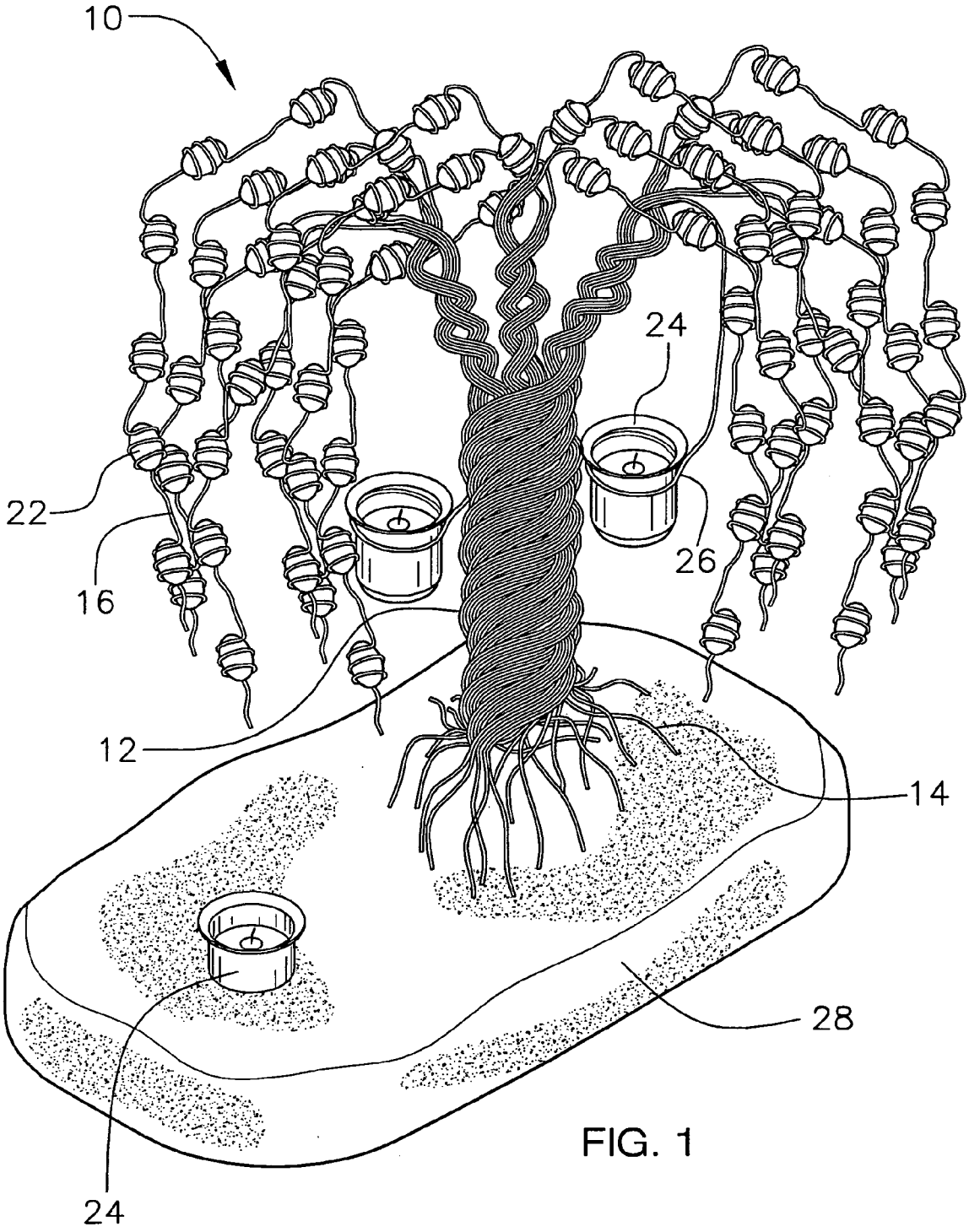
FIG. 1 is a top perspective view of the preferred embodiment of the article of manufacture and method for tree shaped candle holder constructed in accordance with the principles of the present invention.

Referring now to the drawings, and particularly to FIGS. 1–5, a preferred embodiment of the article of manufacture and method for tree shaped candle holder of the present invention is shown and generally designated by the reference numeral 10.

In FIG. 1, a new and improved article of manufacture and method for tree shaped candle holder 10 of the present invention for tree shaped candle holders comprised of twisted wire is illustrated and will be described. More particularly, the article of manufacture and method for tree shaped candle holder 10 has at least one twisted tree wire 12 having a root end 14 and a branch end 16. In the present embodiment the tree wire is comprised of aluminum, but can be comprised of copper in other embodiments. At least one bead 22 is wrappingly connected to the tree wire 12 adjacent to the branch end 16. In the present embodiment the bead is comprised of colored glass, but can be comprised of stone or wood in other embodiments. At least one votive cup 24 is wrappingly connected to the tree wire 12. In the present embodiment the votive cup is comprised of glass. A base 28 is connected to the tree wire root end 14. The base 28 has a votive cavity 30 therein. In the present embodiment the base is comprised of concrete, but can be comprised of plaster in other embodiments. In the present embodiment the tree shaped candle holder is approximately 10 inches high, 12 to 24 inches long and 12 to 24 inches wide. In other embodiments the candles can be replaced with low wattage lights.

Figure 2:
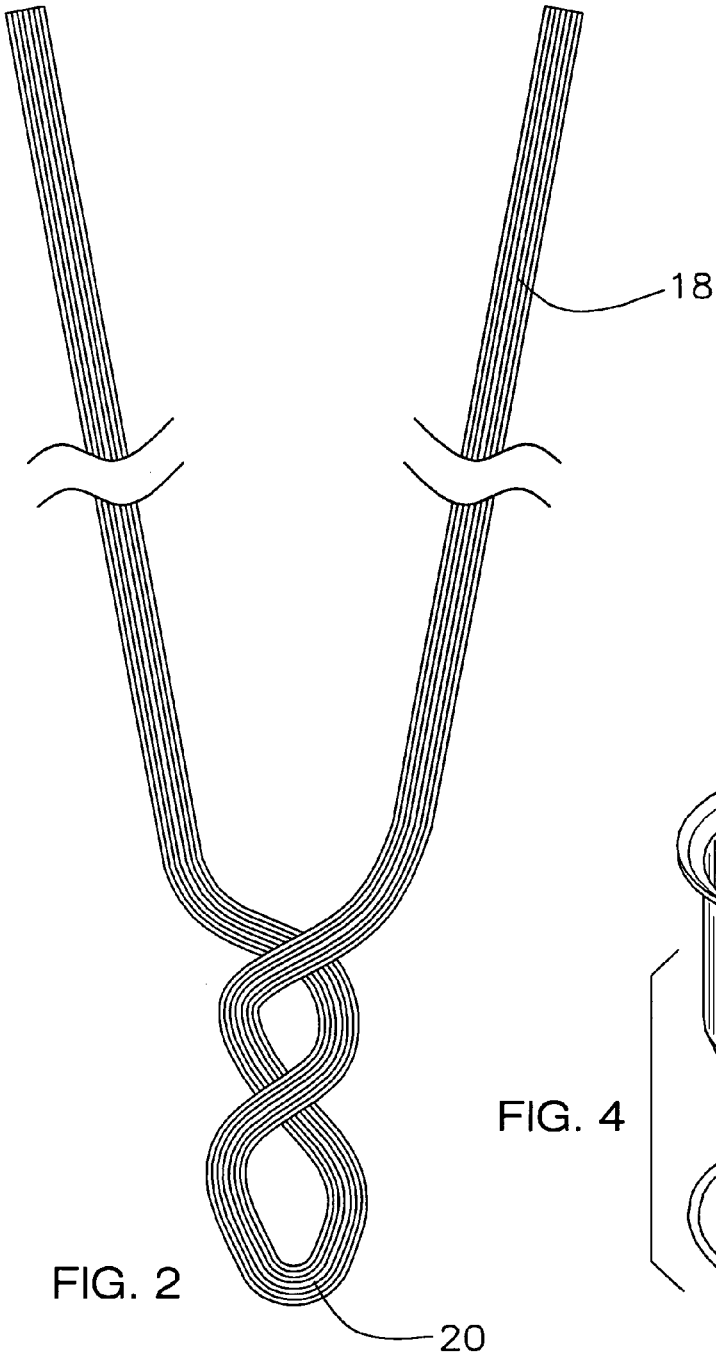
FIG. 2 is a top side view of the article of manufacture and method for tree shaped candle holder of the present embodiment of the invention.
Figure 3:
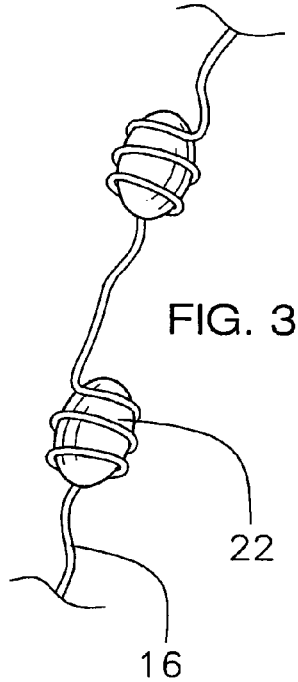
FIG. 3 is a top side view of the article of manufacture and method for tree shaped candle holder of the present embodiment of the invention.
Figure 4:
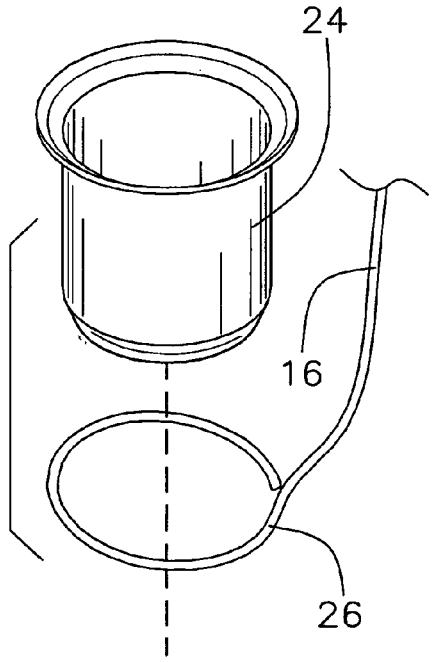
FIG. 4 is a top perspective view of the article of manufacture and method for tree shaped candle holder of the present embodiment of the invention.

In FIGS. 2–4, the method of constructing the tree shaped candle holder has the steps listed below. Bend the tree wire 12 in the shape of the V having a set of two tree leg wires 18 approximately eight to ten feet long and a bent center section 20. Twist the tree leg wires 18 around each other. Separate tree leg wires 18 from each other. Wrap the bead 22 with the separated tree leg wires 18. Form a votive cup ring 26 from the tree leg wires 18. Cut the tree wire bent center section 20 to form the tree wire root end 14. Shape the cut tree wire root end 14. Mix concrete to form the base 28. Insert the tree wire root end 14 into the concrete base 28 when the base 28 is beginning to cure. Press the votive cup 24 into the concrete base 28 to create the votive cavity therein 30.

Figure 5:
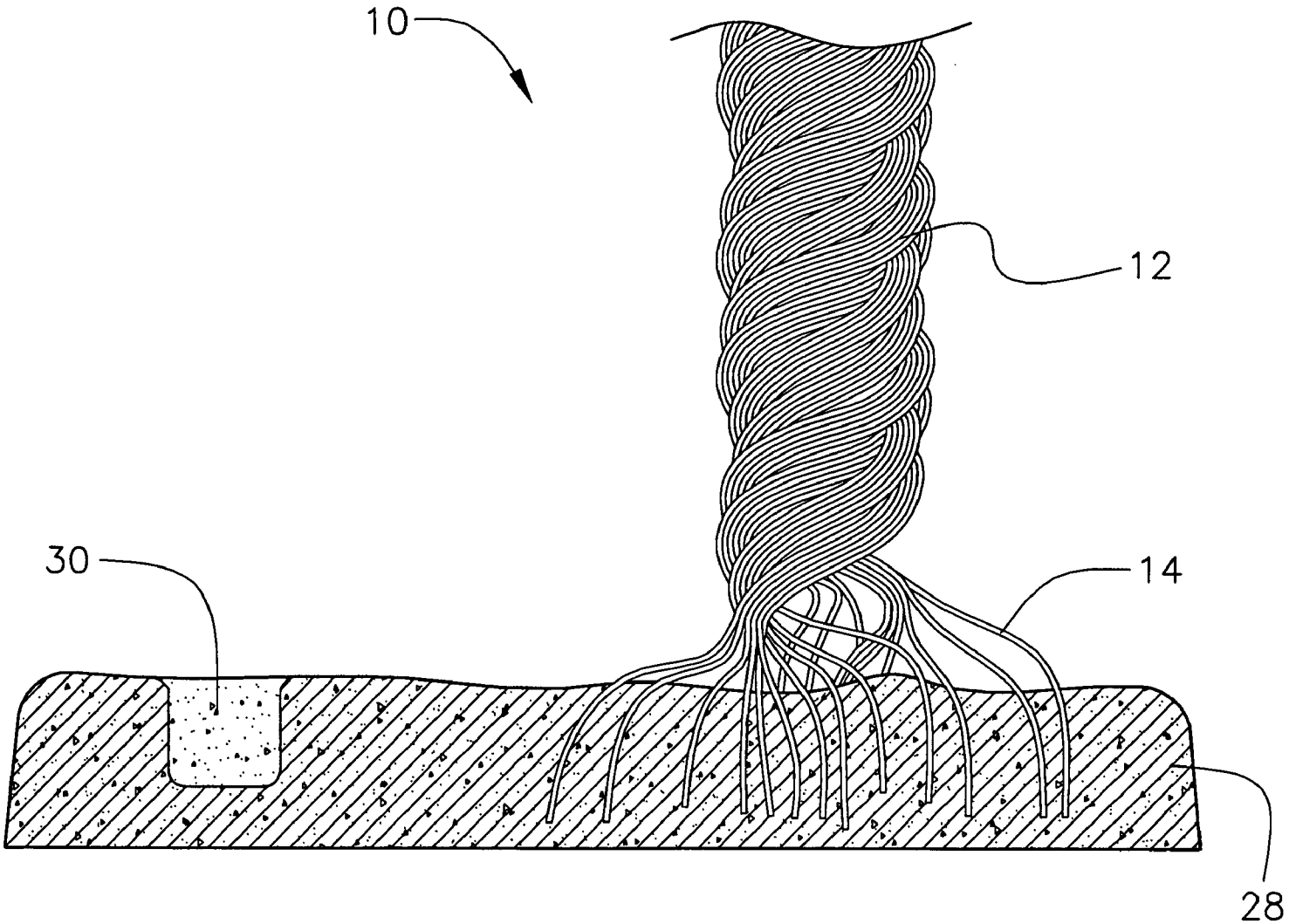
FIG. 5 is a section view of the article of manufacture and method for tree shaped candle holder of the present embodiment of the invention.

In FIG. 5, the tree shaped candle holder 10 is illustrated and will be described. More particularly, the article of manufacture and method for tree shaped candle holder 10 has the twisted tree wire 12 having the root end 14. The base 28 is connected to the tree wire root end 14. The base 28 has the votive cavity 30 therein.

While a preferred embodiment of the article of manufacture and method for tree shaped candle holder has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable sturdy metal such as copper may be used instead of the aluminum described. Also, the beads may be made of wood or stone.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

I claim:

1. A tree shaped candle holder comprising:

at least one twisted tree wire having a root end and a branch end;

at least one bead wrappingly connected to said tree wire adjacent to said branch end;

at least one votive cup wrappingly connected to said tree wire; and a base connected to said tree wire root end, said base having a votive cavity therein;

wherein said tree wire is comprised of aluminum; said bead is comprised of colored glass; and said base is comprised of plaster.

2. A method of constructing a tree shaped candle holder comprising the steps of:

bending at least one tree wire in the shape of a V having two tree leg wires approximately eight to ten feet long and a bent center section;

twisting the tree leg wires around each other;

separating tree leg wires from each other;

wrapping beads with said separated tree leg wires;

forming a votive cup ring from tree leg wires;

cutting said tree wire bent center section to form a tree wire root end;

shaping said cut tree wire root end;

mixing a concrete base;

inserting said tree wire root end into said concrete base when said base is beginning to cure; and pressing a votive cup into said concrete base to create a votive cavity therein.

* * * * *